US006002334A

United States Patent [19]

Dvorak

[11] Patent Number: 6,002,334

[45] Date of Patent: Dec. 14, 1999

[54] AUTOMATED ITEM COUPLING SYSTEM AND METHOD THEREFOR

[75] Inventor: Joseph L. Dvorak, Boca Raton, Fla.

[73] Assignee: Motorola, Inc., Schaumburg, Ill.

[21] Appl. No.: 09/110,340

[22] Filed: Jul. 6, 1998

[51] Int. Cl.[6] ..... G08B 13/14

[52] U.S. Cl. ..... 340/568.1; 340/539; 340/571; 340/573.1; 340/573.4

[58] Field of Search ..... 340/568.1, 539, 340/571, 573.1, 573.4, 988

[56] References Cited

U.S. PATENT DOCUMENTS

| | | | |
|---|---|---|---|
| 4,593,273 | 6/1986 | Narcisse | 340/539 |
| 5,438,321 | 8/1995 | Bernard et al. | 340/573.1 |
| 5,442,805 | 8/1995 | Sagers et al. | 455/456 |
| 5,493,878 | 2/1996 | Murray, Jr. et al. | 70/58 |
| 5,497,149 | 3/1996 | Fast | 340/988 |
| 5,635,897 | 6/1997 | Kuo | 340/311.1 |
| 5,646,593 | 7/1997 | Hughes et al. | 340/573.4 |
| 5,661,492 | 8/1997 | Shoap et al. | 342/465 |
| 5,757,271 | 5/1998 | Andrews | 340/568.1 |
| 5,796,338 | 8/1998 | Mardirossian | 340/568.1 |
| 5,821,854 | 10/1998 | Dorinski et al. | 340/539 |

*Primary Examiner*—Benjamin C. Lee
*Attorney, Agent, or Firm*—Andrew S. Fuller

[57] ABSTRACT

A tracking device (100) issues an alert when an item (405) is separated from the device (100) according to programmable characteristics. The tracking device stores information pertaining to the item in a database upon receipt of a command identifying the item as eligible for tracking (510, 520). Separation characteristics between the item and the tracking device are tracked using, at least in part, information stored in the database. Preferably, the tracking device automatically registers the item in the database as a coupled item in response to the item being within a programmable range of the tracking device for at least a programmable period of time (530). The tracking device automatically issues an alert identifying the item when the separation characteristics indicates a separation that exceeds a particular threshold (540).

10 Claims, 5 Drawing Sheets

AUTOMATED ITEM COUPLING SYSTEM AND METHOD THEREFOR

TECHNICAL FIELD

This invention relates in general to tracking devices, and more particularly, tracking devices suitable for personal assistance.

BACKGROUND OF THE INVENTION

Electronic devices are becoming an increasingly important part of everyday life. As these devices become smaller and less obtrusive, there is a desire to have more seamless integration with respect to the way people communicate and interact with their environment. Personal digital assistant devices have been introduced that enable people to organize their daily activities. Such devices usually have scheduling programs that manage appointments and that provide reminders for scheduled items. Many people have found these functions indispensable and continue to seek new applications for enhancing their effectiveness.

A problem exists for people who have a tendency to forget items temporarily placed at a particular location. An application that automatically provides a reminder in such cases would be of great value. Therefore, it would be desirable to have a device, such as a personal digital assistant device, or the like, that was able to track items in a particular environment, and to provide information based on separation characteristics.

DETAILED DESCRIPTION OF THE PREFERRED EMBODIMENT

Figure 1:
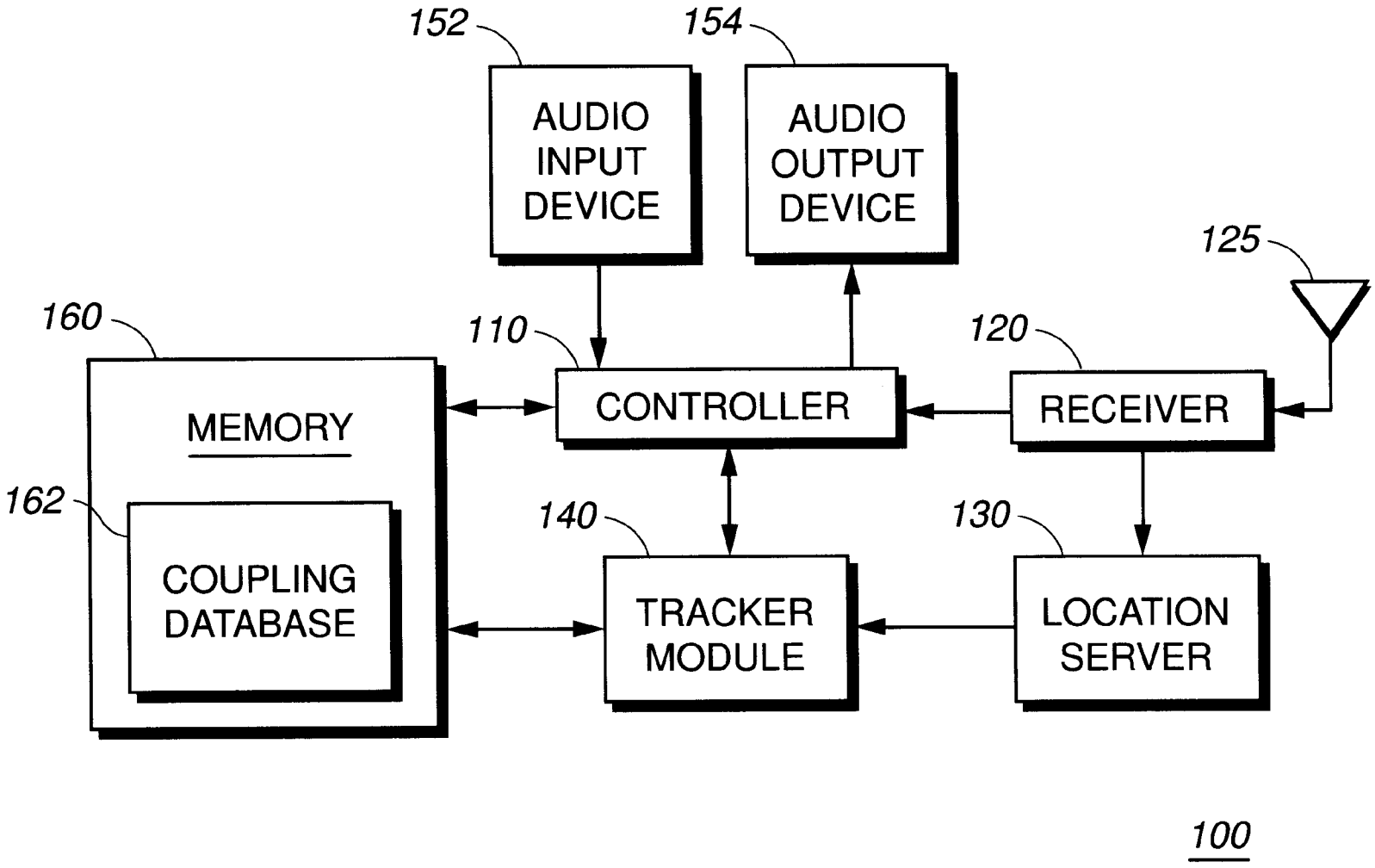
FIG. 1 is a block diagram of a tracking device, in accordance with a present invention.

While the specification concludes with claims defining the features of the invention that are regarded as novel, it is believed that the invention will be better understood from a consideration of the following description in conjunction with the drawing figures, in which like reference numerals are carried forward.

The present invention provides for the logical coupling of an item to a tracking device, and for the automatic provision of an alert when separation characteristics between the item and the tracking device meet a specific criteria. The tracking device stores information pertaining to an item in a database upon receipt of a command identifying the item as eligible for coupling. The separation characteristics between the item and the tracking device are tracked using, at least in part, information stored in the database. The tracking device then automatically issues an alert identifying the item, when the separation characteristics indicate a separation that exceeds a particular threshold. In one embodiment, the tracking device automatically registers the item in the database as a coupled item in response to the item being within a programmable range of the tracking device for a programmable period of time. Subsequently, when the coupled item is again outside the programmable range of the tracking device for a second period of time, the tracking device issues an alert. In a second embodiment, the tracking device obtains initial location information representing the location of the item, and stores this initial location information in the database. As the tracking device changes location, current location information is obtained, and an alert issued when the difference between the current location and the initial location indicates a distance-greater than a particular threshold.

FIG. 1 is a block diagram of a tracking device 100, in accordance with a present invention. The tracking device 100 preferably comprises a radio receiver capable of receiving and processing wireless radio frequency signals. A controller 110 is coupled to a memory 160 and to a receiver 120 to provide communication circuitry. The memory 160 contains data, instructions, and procedures, for operating the tracking device. The receiver 120 is coupled to an antenna 125, and operates under the control of the controller 110. An audio input device 152, such as a microphone, allows for the receipt of voice commands. An audio output device 154 in the form of a speaker, supports speech and other audio output for issuing alert and for other purposes.

According to the present invention, the tracking device 100 includes a tracking module 140, a location server 130, and a coupling database 162, for item tracking and reminder alert services. The location server 130 receives positioning information from an external source, and provides current location information to the tracker module 140. The coupling database 162 stores information needed to reference, track, and issue alerts, for items specified by a user. Thus, the coupling database 162 includes for each item, identifiers, and allowable separation characteristics for each item with respect to the tracking device. Location information is included as needed for each item. The tracking module 140 uses information from the coupling database 162, and from the location server 130, to provide reminder services for items separated from the tracking device beyond a particular threshold.

Figure 2:
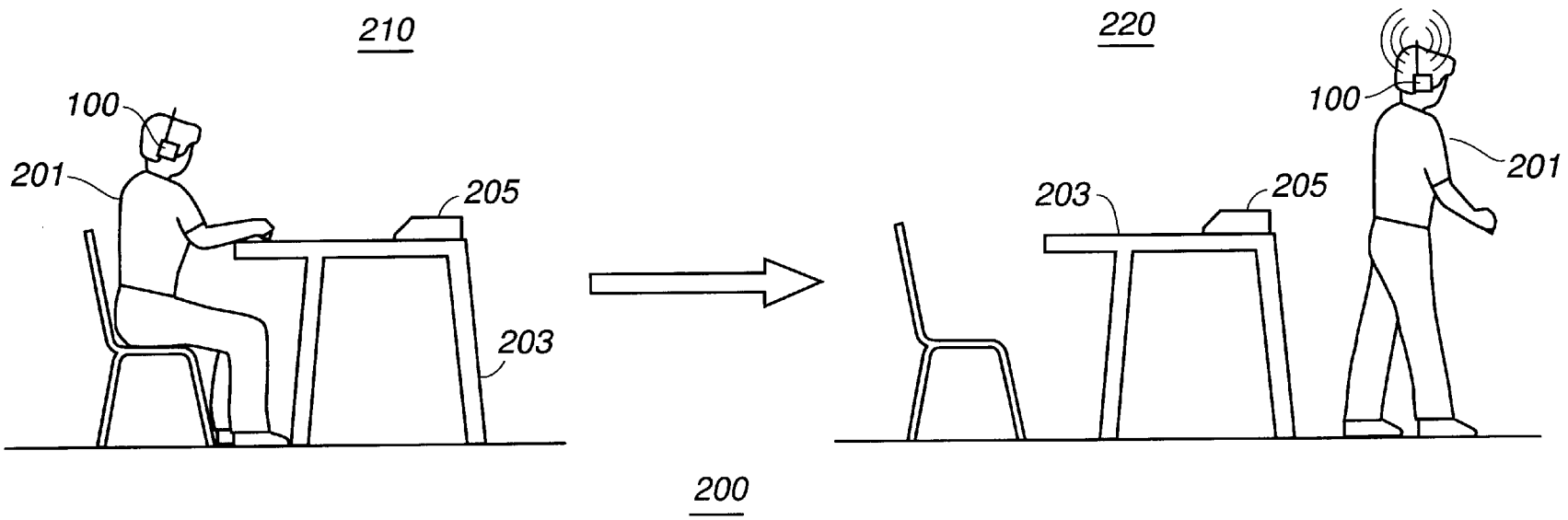
FIG. 2 shows an environment that highlights a first mode of operation for the tracking device, in accordance with the present invention.
Figure 3:
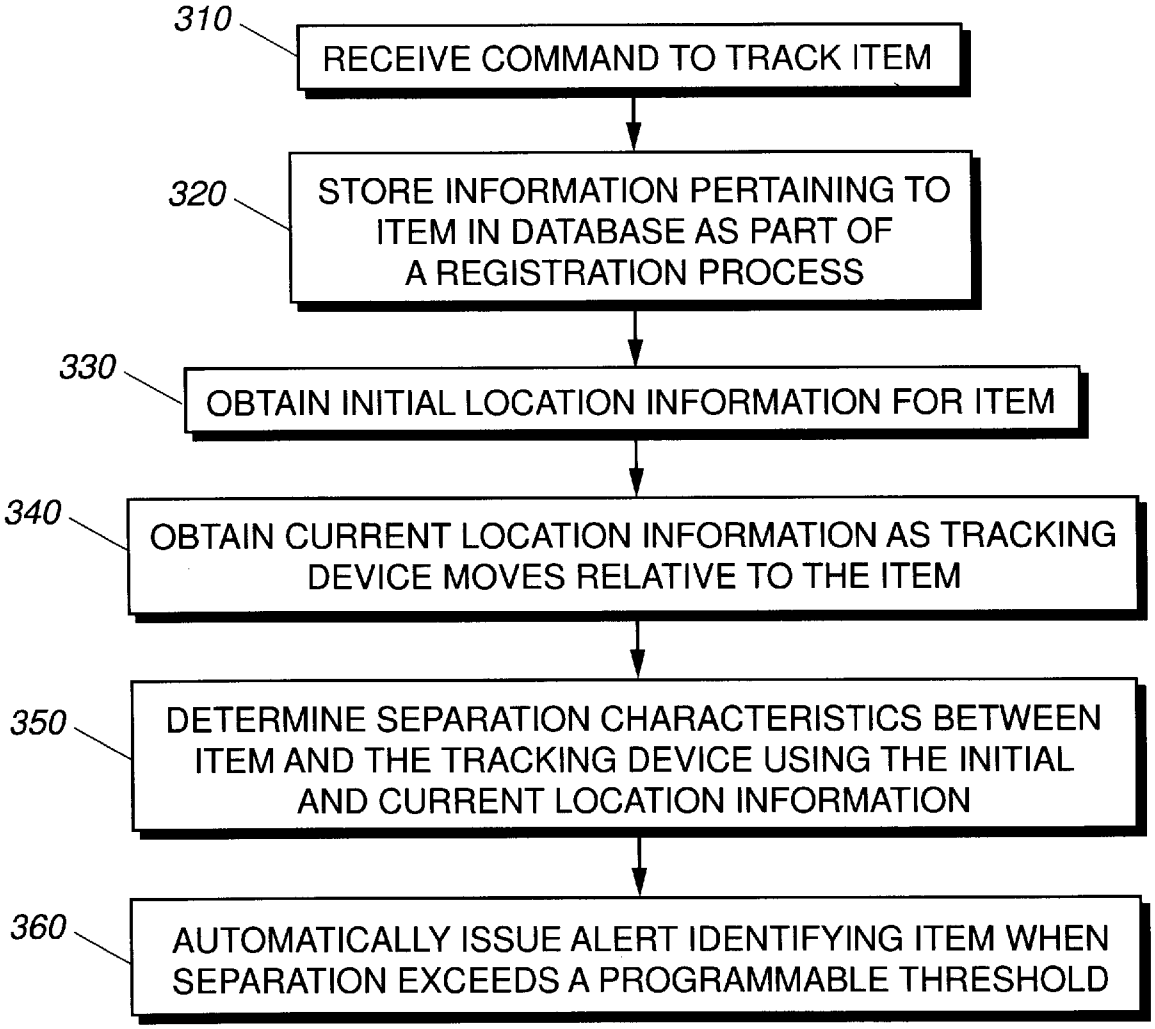
FIG. 3 is a flowchart of procedures used by the tracking device in the first mode of operation for tracking coupled items, in accordance with the present invention.

FIG. 2 shows an environment 200 that highlights operation of the tracking device to couple items, and to alert when such items are separated from the tracking device, in accordance with the present invention. FIG. 3 is a flowchart of procedures 300 used by the tracking device for tracking coupled items, in accordance with the present invention. Referring to FIGS. 2 and 3, at location 210, a user 201 is in the vicinity of an item 205 while seated at a desk 203. The user 201 is shown wearing the tracking device 100, which is in the form of a personal communication device that travels with the user as the user moves about. At location 210, the user issues a command identifying the item 205 as a eligible for tracking. In the preferred embodiment, the user 201 issues a command, such as "couple sunglasses," which identifies the item, in this case the sunglasses, as the coupled item eligible for tracking. The tracking device 100 receives the command to track the item, step 310, and the stores information pertaining to the item in its coupling database as part of a registration process, step 320. Accordingly, the tracking device enters an identifier for the item into its database to register the item as eligible for tracking. Additionally, upon the receipt of the command to track the item, the tracking device obtains initial location information for the item, and stores this initial location information in the database, step 330.

Next, as the tracking device moves relative to the item, the tracking device obtains current location information, step 340. The tracking device then uses the initial location information stored for the item, and the tracking device's current location information, to determine separation characteristics between the item and the tracking device, step 350. In the preferred embodiment, the tracking device determines that the separation characteristics indicate a separation that exceeds the particular threshold, when a comparison between the initial location information of the item and the current location information indicates a difference in distance greater than a programmable range. When separation exceeds the programmable threshold, the tracking device automatically issues an alert identifying the item, step 360.

Thus, at location 220, as the user 201 moves away from the desk 203, such that the tracking device 100 is separated from the item 205, the tracking device issues an alert with the item's identifier, thereby identifying the item 205 as being separated from the tracking device.

According to a second aspect of the present invention, the tracking device automatically registers an item, eligible for tracking, in its database as a coupled item, in response to the item being within a programmable range of the tracking device for a programmable period of time. Additionally, the tracking device automatically takes action, such as by issuing an alert, in response to the tracked item being outside the programmable range of the tracking device for at least another programmable period of time.

Figure 4:
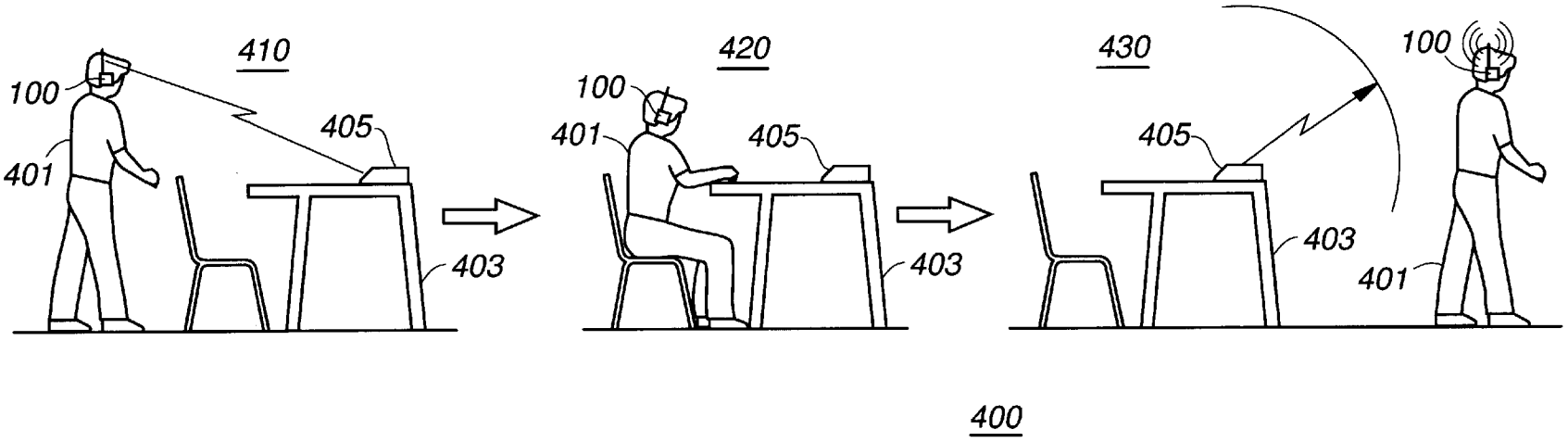
FIG. 4 shows an environment highlighting a second mode of operation for the tracking device, in accordance with the present invention.
Figure 5:
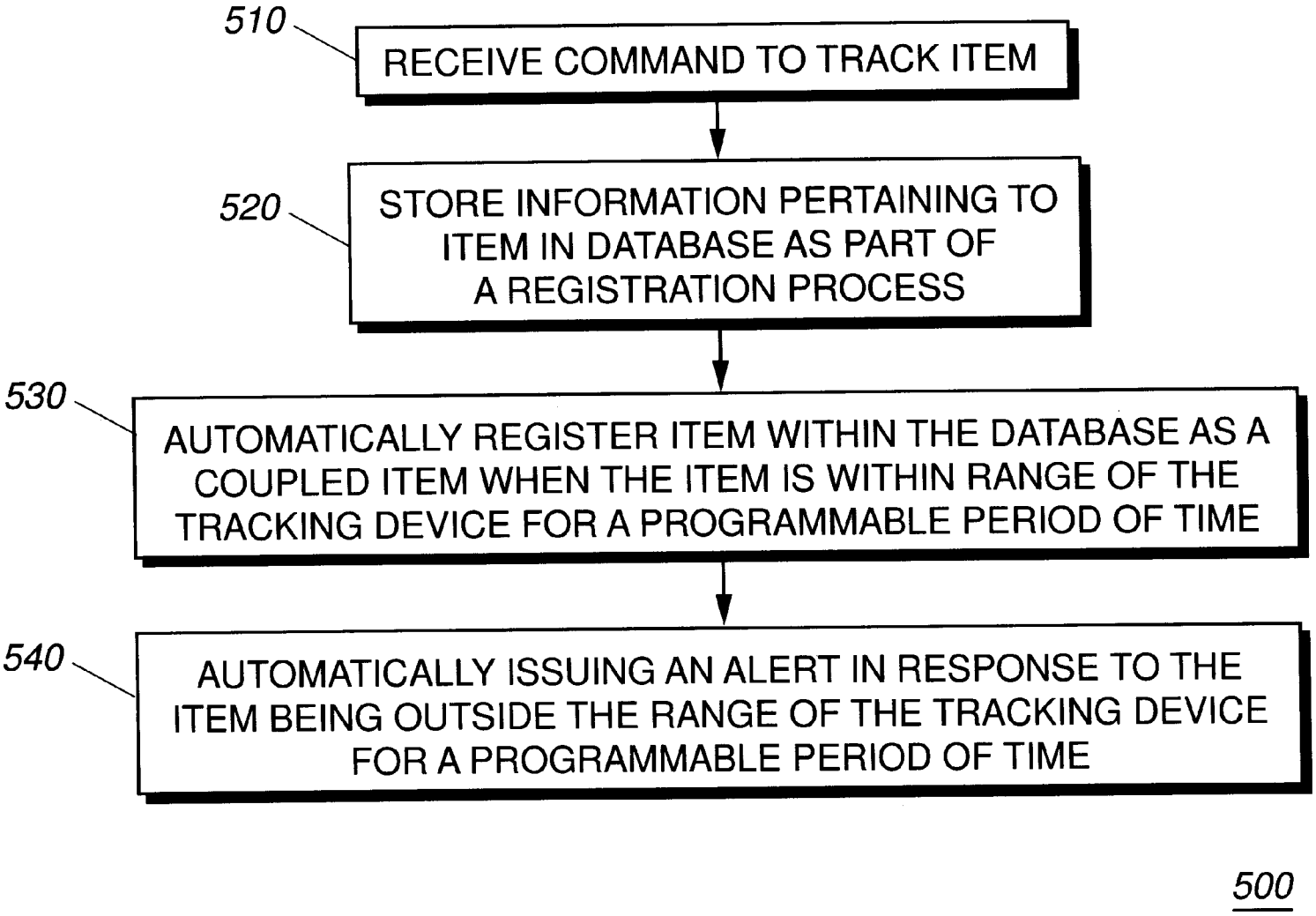
FIG. 5 is a flowchart of procedures used by the tracking device in the second mode of operation.

FIG. 4 shows an environment 400 highlighting another mode of operation for the tracking device, in accordance with the present invention. FIG. 5 is a flowchart of procedures 500 used by the tracking device in the second mode of operation. Referring to FIGS. 4 and 5, at location 410, a user 401 is shown approaching a desk 403 having an item 405 located thereon. Here, the user issues, and the tracking device receives, a command to track or couple an item, step 510. Upon receipt of this command, the tracking device stores information pertaining to the item in its tracking database as part of a registration process, step 520. In the preferred embodiment, the item 405 has a low power radio frequency transmitter (not shown) with a short range. The intensity of a signal emanating from the transmitter is used to set a programmable coupling range associated with the item. In an alternative embodiment, reflective technology is used in which the tracking device transmits a signal that is reflected by a device within the item 405, to provide identification information. At location 410, the tracking device 100 is just outside the transmit range of the transmitter, or the reflective range the internal device, associated with the item 405.

At location 420, the user is shown seated at the desk 403 and positioned near the item 405. Here, the tracking device 100 is within range of the item 405, and monitors for a signal emanating from the item. The tracking device determines that the item is within range when a signal is detected. When the signal is detected for a programmable period of time, indicating that the item is within range of the tracking device for the programmable period of time, the tracking device automatically registers that item within its database as a coupled item, step 530. Thus, while at location 420, the tracking device detects the signal emanating from the item and treats the item as coupled to the tracking device.

At location 430, the user 401 is shown moving away from the desk 403 beyond the range of the signal emanating from the item 405. As the tracking device monitors for a signal emanating from the coupled item, it determines that the item is outside the programmable range when no signal is detected. Accordingly, the tracking device determines that the separation characteristics between the item and the tracking device indicates a separation that exceeds a particular threshold. When such condition exists for a programmable period of time, the tracking device automatically issues an alert identifying the item, step 540. Thus, the user is alerted that the particular item, which should have been coupled to the user, i.e., within a certain distance of the tracking device, has become uncoupled. Moreover, the alert specifically identifies which item has become uncoupled.

The present invention provides significant advantages over the prior art. By interacting with a user's environment in a relatively seamless manner to provide a reminder, or other alert, the tracking device enables the user to more easily manage daily activities. This new type of application can be incorporated into personal digital assistant devices to extend the functionality commonly found in these devices.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for automated item coupling in a tracking device, comprising the steps of:

registering an item as eligible for tracking;

storing information pertaining to the item in a database;

automatically tracking the item using in part the stored item information in response to the item being within a programmable range of the tracking device for at least a first programmable period of time; and automatically taking action in response to the tracked item being outside the programmable range of the tracking device for at least a second programmable period of time.

2. The method of claim 1, wherein the step of automatically taking action comprises the step of issuing an alert that includes an identifier for the item.

3. The method of claim 1, wherein the step of registering an item comprises the steps of:

receiving a command to couple the item; and entering an identifier for the item into a database.

4. The method of claim 1, wherein the step of automatically tracking the item in a database comprises the steps of determining whether the item is within the programmable range based upon a comparison between location information obtained for the item, and location information obtained for the tracking device.

5. The method of claim 1, wherein the step of automatically tracking the item in a database comprises the steps of determining whether the item is within the programmable range based upon receipt, by the tracking device, of a communication signal coming from the item.

6. In a tracking device carried by a user, a method for alerting based on imputed separation characteristics between the user and the item, comprising the steps of:

storing information pertaining to an item in a database upon receipt of a command identifying the item as eligible for tracking;

tracking separation characteristics between the item and the tracking device using, at least in part, information stored in the database, wherein the step of tracking comprises the steps of:

obtaining initial location information of the tracking device upon receipt of the command;

storing the initial location information in the database;

obtaining current location information for the tracking device when moved relative to the item; and determining that the separation characteristics indicates a separation that exceeds the particular threshold when a comparison between the initial location information of the tracking device and the current location information indicates a difference in distance between the tracking device and the item greater than a programmable range; and automatically issuing an alert identifying the item when the separation characteristics indicates a separation that exceeds a particular threshold.

7. In a tracking device carried by a user, a method for alerting when items are separated from the user, comprising the steps of:

storing information pertaining to an item in a database upon receipt of a command identifying the item as eligible for tracking;

tracking separation characteristics between the item and the tracking device using, at least in part, information stored in the database, wherein the step of tracking comprises the steps of:

automatically registering the item in the database as a coupled item in response to the item being within a programmable range of the tracking device for at least a first programmable period of time; and determining that the separation characteristics indicates a separation that exceeds the particular threshold when the coupled item is outside the programmable range of the tracking device for at least a second programmable period of time; and automatically issuing an alert identifying the item when the separation characteristics indicates a separation that exceeds a particular threshold.

8. The method of claim 7, wherein the step of determining that the separation characteristics indicates a separation that exceeds the particular threshold comprises the steps of:

monitoring for a signal emanating from the item; and determining that the item is within the programmable range when a signal emanating from the item is detected.

9. The method of claim 8, wherein the step of automatically registering comprises the steps of:

monitoring for a signal emanating from the coupled item; and determining that the item is outside the programmable range when a signal emanating from the coupled item is not detected.

10. A system for alerting when items are separated from a user, comprising:

a user interface having an input device for receiving a command from the user, and an output device for presenting an alert to the user;

a database having stored therein a plurality of items coupled for tracking;

a location server having an output of current location information; and a tracker module operatively connected to the user interface, to the database, and to the location server, and responsive to the output of current location information to track separation characteristics with respect to a coupled item by storing, as initial location information, current location information output upon receipt of a command from the user, and by comparing current location information subsequently outputted with the stored initial location information, and to automatically issue an alert identifying the coupled item when the separation characteristics indicates a separation that exceeds a particular threshold.

* * * * *